United States Patent [19]

Dumbeck et al.

[11] Patent Number: 4,834,250

[45] Date of Patent: May 30, 1989

[54] DECORATIVE PROTECTIVE HOODS FOR WATER DISPENSERS

[75] Inventors: Richard F. Dumbeck, 104 Dumbeck Dr., Elgin, Tex. 78621; Mark L. Samuelson, Elgin, Tex.

[73] Assignee: Richard F. Dumbeck, Elgin, Tex.

[21] Appl. No.: 123,213

[22] Filed: Nov. 20, 1987

[51] Int. Cl.[4] ..... B65D 1/02; B65D 23/00; B65D 23/08

[52] U.S. Cl. ..... 215/100 R; 215/12.1; D9/444

[58] Field of Search ..... 150/52 R, 52 F; 62/389, 62/397; 229/89; 215/1 R, 12.1, 12.2, 13.1, 100 R; D9/444

[56] References Cited

U.S. PATENT DOCUMENTS

| | | | |
|---|---|---|---|
| D. 126,192 | 4/1941 | Stone et al. | D7/300 |
| D. 266,056 | 9/1982 | Lear | D9/444 |
| D. 289,614 | 5/1987 | Sanchez et al. | D9/444 X |
| 747,025 | 12/1903 | White | 150/52 F |
| 895,781 | 8/1908 | Newell | 62/397 |
| 1,161,092 | 11/1915 | Wardell | 215/12.1 |
| 1,869,756 | 8/1932 | Kinard | 150/52 F |
| 1,972,800 | 9/1934 | Shelor | 62/397 X |
| 2,035,384 | 3/1936 | Hinchliff | 150/52 R |
| 2,142,301 | 1/1939 | Buchalter | 150/52 R |
| 2,767,960 | 10/1956 | Fast | 62/397 X |
| 3,367,133 | 2/1968 | Dreis et al. | 62/397 X |
| 3,760,968 | 9/1973 | Amberg et al. | 215/12.2 |
| 3,779,298 | 12/1973 | Piccirilli et al. | 215/12.1 X |
| 3,820,677 | 6/1974 | Garcia | 215/12.2 |
| 3,906,129 | 9/1975 | Damois | 150/52 R X |
| 3,937,853 | 2/1976 | Shank, Jr. | 215/12.2 X |
| 4,401,245 | 8/1983 | Zills | 215/12.1 X |
| 4,526,280 | 7/1985 | Taylor | 215/12.1 X |
| 4,626,455 | 12/1986 | Karabedian | 215/12.2 X |

*Primary Examiner*—Sue A. Weaver

*Attorney, Agent, or Firm*—Laurence R. Brown; Alfred J. Mangels

[57] ABSTRACT

A water dispensing system provides a decorative and protective form fitting hood of a sheetlike material, preferably a woven fabric, encompassing a water bottle extending upwardly from a water dispensing stand. A water repellant strong fabric, such as "Nylon" taffeta, protects the bottle from damage, scratching, heating rays, algae forming light and forms a shatter protection member that confines any broken bottle parts within the hood. For cylindrical bottles the hood is formed from one circular and one rectangular fabric piece. The rectangular piece forms a lower closeable flap to facilitate mounting and fitting of the hood over a bottle.

9 Claims, 1 Drawing Sheet

DECORATIVE PROTECTIVE HOODS FOR WATER DISPENSERS

TECHNICAL FIELD

This invention relates to water dispensing systems, and more particularly it relates to decorative safety hoods protecting water bottles mounted in dispenser stands.

BACKGROUND ART

In water dispensers, a replaceable bottle is mounted, with neck and spout downwardly extending into an opening in the ledge of a dispensing stand, where the bottle is free standing and held in place by gravity. The bottles are reused, and thus may become scratched and unsightly or dangerous. Consider the fact that a glass bottle with a scratch thereon, similar to that made by a glass cutter, could shatter and burst, with the internal force of the water tending to "explode" the glass fragments dangerously away from the dispenser.

Also, when in use, the bottles may be scratched, impacted or pierced by objects that contact the bottle surface. It is certainly desirable to protect bottles in use from damage, defacing or catastophic failure under use conditions.

Furthermore, when bottles are reused and become unsightly it is desirable to hide them within a decorative covering, as for example shown in U.S. Pat. No. Des. 126,192, Apr. 1, 1941, L. L. Stone, et al. Thus, an outer cabinet of a decorative nature is provided to surround a water bottle. Such cabinets, however, are very expensive, not conducive to variable decorative tastes, and are cumbersome to use.

Also it is known to provide insulating or cooling jackets for water or milk bottles or cans as may be seen from U.S. Pat. Nos. 1,869,756, Aug. 2, 1932 to A. A., Kinard and 3,906,129, Sept. 16, 1975 to P. Damois. Not only are these expensive and awkward to use, but they for the most part are not necessary and produce problems for water dispensing systems now generally in use. That is, the water generally is not cooled in the bottle, and thus insulation or temperature modification jackets are meaningless. Furthermore, if an insulating jacket were used, it would tend to accumulate moisture from sweating and encourage growth of fungus and bacteria, an undesirable result about potable drinking water.

Because of reuse of the bottles, it is probable that accumulation of dirt and bacteria may occur on the outside of the bottles. This is not only unsightly but it may lead to contamination of potable water. Thus, bacteria or undesirable chemical deposits on the outside of the bottle, because of the way it is oriented in a dispensing stand, are subject to entry into the dispensing area by being carried off the outer bottle surface in dripping sweat on the outside of the bottle.

Therefore it is a general objective of this invention to resolve these prior art problems, and a more specific objective is to improve the safety and appearance of a water bottle being used in a water dispensing system.

Other objects, features and advantages of the invention will be found throughout the following description, the appended drawings and the claims.

DISCLOSURE OF THE INVENTION

A decorative hooded protection cover is provided, which tightly hugs a water dispensing bottle mounted in a dispensing system. This hood protects the bottle from disfiguration from scratching, etc. and provides a variably changeable decor that can fit different tastes and environments.

Furthermore, safety about the dispenser is improved, to avoid water contamination, and the prospect of catastrophic failure of the water bottle. Thus, a strong water repellant sheet material, preferably a woven fabric of "Nylon" or like plastic material that can breath and thus avoid accumulation of condensed vapors, forms a form fitting hood tightly hugging the water bottle, thereby to reduce the likelihood of sweating on the outside of the bottle and dripping of residue into the water dispenser, or the retention of sweat in an environment that will encourage growth of bacteria in the vicinity of the potable water. Additionally the hood is decorative in a manner that does not show the sweat easily or attract dust to long retained damp wettable surfaces that will cause the hood appearance to deteriorate or look bad.

The hood is thus easily made for cylindrical bottles from two pieces of woven fabric, namely a circular and rectangular piece. They are fastened together, such as by sewing, to produce the form fitting hood, with one seam upwardly extending on the usually hidden back of the bottle, and defining a closure flap at the open end of the hood for fitting over the bottom of the bottle, thereby facilitating the fitting of the hood. The closure flap is readily opened and closed at will by means of a frictionally sealed tab, such as available under the tradename "Velcro", for example.

THE PREFERRED EMBODIMENT

Figure 1:
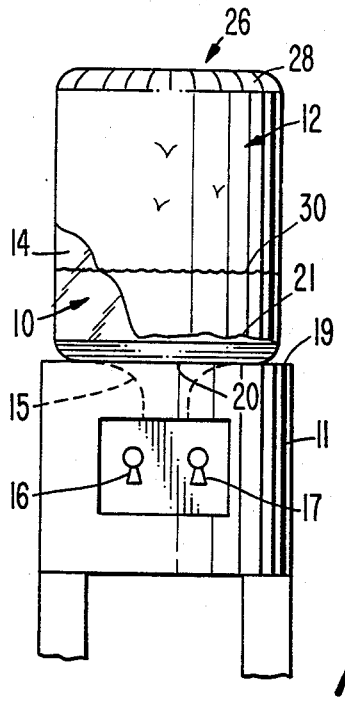
FIG. 1 is a front view sketch, in elevation, partly broken away and partly in phantom view, of a water dispensing system embodying the invention.
Figure 2:
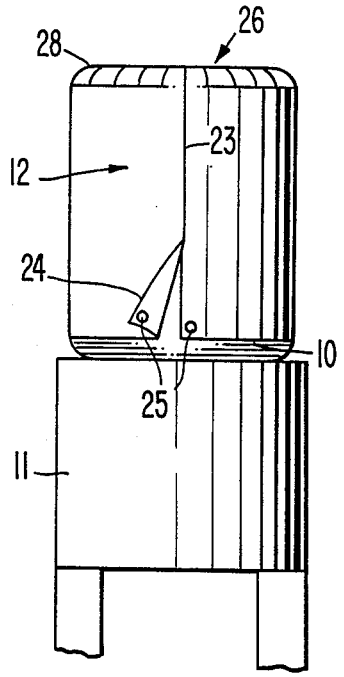
FIG. 2 is a rear view sketch of the dispensing system, showing a mounting flap and seam on a decorative hood provided in one embodiment of the invention.

As may be seen from FIGS. 1 and 2, a water dispensing system is illustrated with three basic elements, namely: bottle 10, dispensing stand 11 and protective hood 12. This particular bottle has a cylindrical body portion 14 and a neck portion 15 opening into an outlet spout extending from one end of the bottle opposite to the body portion. Other bottle dimensions and shapes may be used however without departing from the spirit and scope of this invention.

The dispensing stand 11, conventionally contains cooling and heating elements for dispensing water from the bottle through the respective two discharge faucets 16, 17. The water bottle 10 is thus kept at ambient temperature, where sweating or condensation is not frequent, but can occur with changes of environmental temperature and humidity conditions such as imposed by air conditioning or heating equipment. Such sweating, when it occurs, is undesirable, since it can cause dripping from the body 14 of the bottle 10 down into the dispensing stand to carry dirt or contamination including bacteria from the reused bottle outer surface into the potable water that is to be discharged from the faucets 16, 17.

There is another problem with hooded bottles, since for example an untreated cotton or porous paper, cellulose or plastic cover will be wettened and may hold dampness for long time periods. This favors bacteria growth and tends to accumulate dust and dirt detracting from the decorative value of the hood. Therefore the hood is made from a non-wettable material that can breathe to let out vapor without dripping of accumulated sweat into the dispenser stand. Preferably the hood for decorative value, sanitary value and further safety value hereinafter discussed is thus made of a plastic water-shedding woven fabric material such as "Nylon" brand taffeta.

The reusable bottles 10 provide further problems, both of the decorative and safety nature. Thus, the outer surface tends to become scratched and worn, so that the bottles cannot retain their original decorative value, if any. Even more serious however, is the possibility of catostrophic failure due to bottle scratching or other damage. If the bottles are glass, outside surface scratches, incurred in handling, could act as a glass cutter marking to cause the glass to break or shatter. In such case, the hood is a protective safety covering that keeps the internal water pressure from "exploding" the bottle or scattering glass fragments, and keeps the bottle fragments confined to the vicinity of the hood.

The dispensing stand or cooler 11 has a top ledge 19 with an opening 20 for receiving the neck of the bottle 10 thereinto into a stably supported position by reason of gravity for holding the bottle 10 until its water contents are dispensed, and a newly filled substitute bottle is replaced into the opening 20. The neck portion 15 of the bottle 10 thus invisibly extends within the stand in the dispensing postion, with the cylindrical (in this embodiment) body portion 14 extending upwardly as a visible towerlike structure from the ledge 17.

Figure 4:
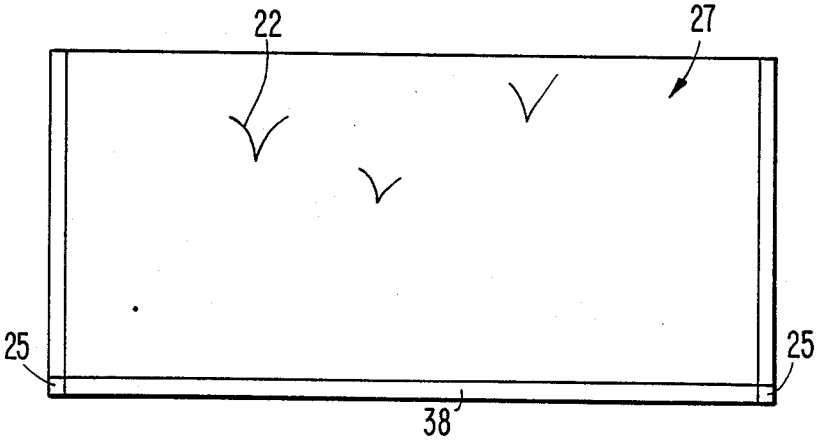
FIG. 4 is a plan view of a hemmed piece of fabric, with accompanying decorative design, which forms the other fabric piece of the hood, and forms a manually operable closure flap.

The fabric form fitting protective hood 12 hugs the body portion of the bottle 10 closely and visibly encompasses the portion of the bottle extending upwardly from the ledge 17. The hood 12 terminates in its open end 21 to attain a position about and adjacent to a lower extremity of the circumference of the bottle. From its front or visible view, it may carry a logo or decorative design, best seen from the seagulls 22 viewed in FIG. 4. From its back view (FIG. 2), a single longitudal seam 23 extends vertically up the bottle body portion, and terminates at its lower end in a manually openable and resealable flap 24, with the frictionally actuated mating tabs 25, such as squares of material available under the tradename "Velcro".

Figure 3:
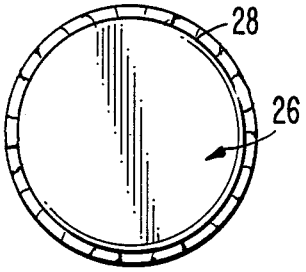
FIG. 3 is a top view (as mounted in a dispenser) of a cylindrical bodied water bottle with a hood mounted thereon, showing the circular configuration of one of the two fabric pieces forming the hood.

The fabric cover is simply made from two pieces, namely the circular panel 26 at the top of the assembled bottle body 14, as shown in FIG. 2, and the rectangular panel 27 shown in FIG. 3. These two pieces are stitched or otherwise affixed together at a seam 28 around the upper periphery of the bottle body 14, and along the seam 23 to form the cylindrical hood 12 of appropriate dimensions to closely hug the outer surface of the bottle body 14. The hems 38 are preferably formed in any fabric material to appear for example at the bottom edge 21 of the hood, along the seam 23 and the exposed edges of flap 24. The fabric of tightly woven thin taffeta of "Nylon" or other strong plastic water shedding fiber is strong enough to retard penetration of instruments to damage the outer bottle surface and to confine bottle fragments within the hood in the event the bottle shatters.

As indicated at 30 in FIG. 1, the hood may be made transparent or transluscent enough to monitor the level of water in the bottle. However, the material comprises a light filter that reduces water heating (or cooling) by radiation, and retards the growth of algae within the bottle. The color of the fabric may be made to match the decor of an office or the like. The logo or design may be an advertisement, and the simplicity and low cost of this hood is such that it might be provided by the water filling source servicing the water dispenser system with fresh water filled bottles.

Having therefore advanced the state of the art and provided a combination of novel and useful features solving problems of the art heretofore not solved, those features of novelty defining the spirit and scope of this invention are set forth with particularity in the appended claims.

We claim:

1. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material is a woven fabric that sheds water and that does not readily wetten, made to confine any sweating about the bottle invisibly inside the hood.

2. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material has a strength sufficient to retard penetration of instruments and scratching of the outer bottle surface, and to confine bottle fragments within the hood upon shattering.

3. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material has a back portion with a seam and a manually operable flap extending therefrom and having a front portion with a decorative design visible thereon.

4. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material comprises a light filter for reducing water heating, radiation and growth of algae within the bottle.

5. A water dispensing system with a decorative hooded protection cover tightly hugging a water dispenser bottle, comprising in combination, a bottle having a body portion with outer dimensions and predetermined shape and having neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material is a water shedding "Nylon" taffeta woven fabric.

6. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the bottle is substantially cylindrically shaped, and the hood comprises one circular piece and one rectangular piece of the sheet material fastened together.

7. The water dispensing system of claim 6 wherein the rectangular piece has a visible seam running along the height of the bottle body portion extending from the ledge.

8. The water dispensing system of claim 7 wherein the lower portion of the seam opens into a flap, and the flap has a frictional fastener about the lowermost edge of the flap with a corresponding mating frictional fastener located on the lower edge of the hood to hold the flap in closed position along the seam.

9. A water dispensing system with a decorative hooded protection cover tightly hugging a water dispenser bottle, comprising in combination, a bottle having a body portion with outer dimensions and predetermined shape and having a neck portion opening into an outlet spout extending from one end of the bottle opposite said body portion, a water dispensing stand having a top receptacle ledge with an opening for receiving the neck of the bottle thereinto in a stable storage position with the neck invisibly extending within the stand in a dispensing position and the body portion extending upwardly as a visible towerlike structure on the ledge, and a form fitting protective hood of a thin sheetlike water repellant material hugging and encompassing the bottle body portion extending toward the ledge and terminating in a lower extremity about the circumference of the bottle positioned adjacent the ledge wherein the material is a removable fabric sheet body that can breathe which is transparent enough to monitor the level of water in the bottle.

* * * * *